US006057009A

United States Patent [19]

McGlew

[11] Patent Number: 6,057,009

[45] Date of Patent: May 2, 2000

[54] HAND HELD MEMORY DEVICE

[76] Inventor: John J. McGlew, Box 823, E. Lake Rd., Tuxedo Park, N.Y. 10987

[21] Appl. No.: 09/032,856

[22] Filed: Mar. 2, 1998

[51] Int. Cl.[7] ..... A44C 23/00

[52] U.S. Cl. ..... 428/3; 434/246

[58] Field of Search ..... 116/205, 200, 116/201; 235/1 D, 1 R, 1 A; 428/3; D99/26, 25; 434/246, 245

[56] References Cited

U.S. PATENT DOCUMENTS 1,661,877 3/1928 Costello .
2,213,516 9/1940 Beehan .
2,376,266 5/1945 Moore .
2,721,398 10/1955 Alonso et al. .

*Primary Examiner*—Deborah Jones
*Assistant Examiner*—Wendy Boss
*Attorney, Agent, or Firm*—McGlew and Tuttle, P.C.

[57] ABSTRACT

A memory aid includes a sheet or strip having one face or side shaped to be accommodated in the palm of ones hand and; for example, it is preferably provided with one or more recesses adapted to be retained on one or more fingers (a so called ergonomic shape). Another face of the strip includes indicia, such as a raised, or beaded portion (a protuberance) corresponding to the prayers or memorabilia to be said. As a further advantage the device includes an end portion containing a crucifix or cross or some other reminder of religions or other information.

8 Claims, 1 Drawing Sheet

HAND HELD MEMORY DEVICE

FIELD OF THE INVENTION

This invention relates in general to memory devices and in particular to a new and useful rotary plate for keeping track of the number of prayers one has said particularly the prayers of the rosary.

BACKGROUND OF THE INVENTION

At the present time rosary beads are used by persons to make sure the prayers one has said are of a number of arrangement recognized by the devout as being correct. As an aid to doing this it is known to have a round device with beads, or other indications which may be slipped over one of the users fingers.

Worry beads have a similar design, involving beads with central holes connected to a string. The beads may be moved from one group to another, for counting, saying successive prayers or for keeping ones fingers active while thinking (worrying).

SUMMARY AND OBJECTS OF THE INVENTION

In accordance with the present invention the memory aid comprises a sheet or strip having one face or side shaped to be accommodated in the palm of ones hand and; for example, it is preferably provided with one or more recesses adapted to be retained on one or more fingers (a so called ergonomic shape). Another face of the strip includes indicia, such as a raised, or beaded portion (a protuberance) corresponding to the prayers or memorabilia to be said. As a further advantage the device includes an end portion containing a crucifix or cross or some other reminder of religions or other information.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
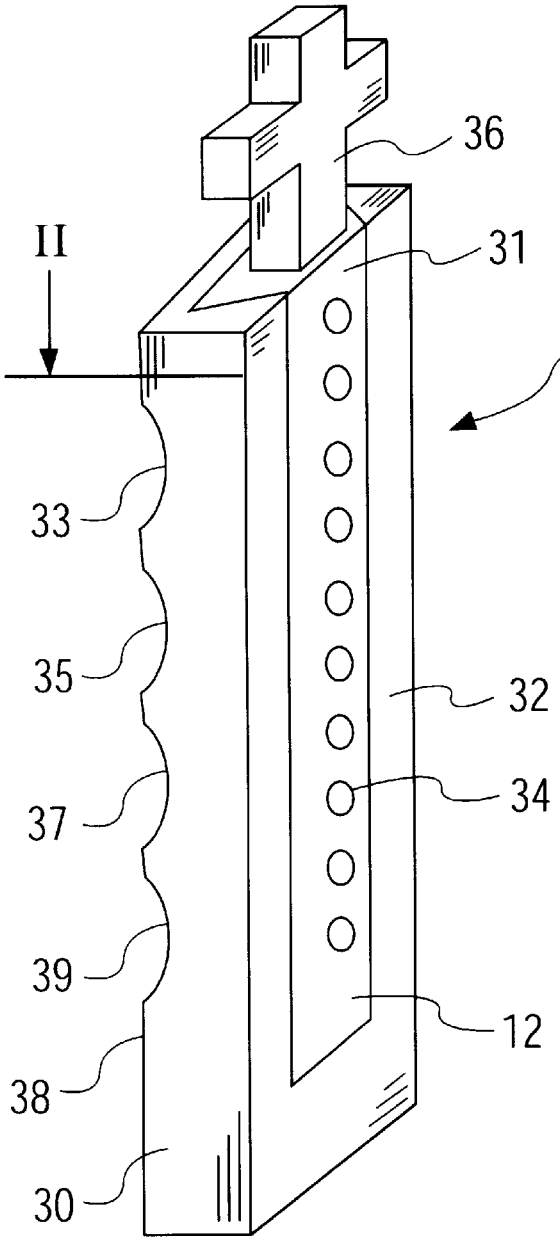
FIG. 1 is a perspective view of an embodiment of a hand held memory device constructed in accordance with the invention.
Figure 2:
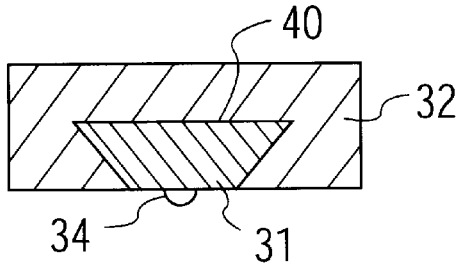
FIG. 2 is a cross sectional view of the device of FIG. 1.

The invention comprises a reminder helper generally referred to a prayer reminder 10 which may be used to remind the user of some information such as a counter or as in this case a rosary. The rosary includes a strip or band having a counting side or prayer reminder side 12. In this example the reminder side 12 has ten indicators 34. The end or top may have a prayerful reminder such as a cross 36.

When a rosary is said the device 10 is positioned over the persons hand up to the persons palm. The cross 36 is used to contemplate the start of the rosary. Then one of the sets of mysteries is selected by referring to printed material. Then 10 Hail Marys are said by reference to the elements 34.

FIG. 1 shows an embodiment where the device is a two part unit including base unit 30 and slide element 31. The device includes a counting side or payer reminder side 32. In this example the reminder side 32 has ten indicators 34 which are projections fixed on slide element 31. Element 31 may be caused to slide relative to base unit 30. The end or top may has a prayerful reminder in the form of the cross 36.

The slide element 31 is positioned in a slot 40 formed in the base 32. The shape of the slot preferably is complementary to the shape of that portion of the slide that engages the slot. The shape further maintains the slide 31 in the slot 40, but allows relative sliding movement. The shape shown in FIG. 4 is a dovetail shape but other shapes that retain the slide are possible.

The opposite side 38 is provided with a palm and finger engagement surface including engagement recesses 33, 35, 37 and 39 to engage each of ones fingers.

While specific embodiments of the invention have been shown and described in detail to illustrate the application of the principles of the invention, it will be understood that the invention may be embodied otherwise without departing from such principles.

What is claimed is:

1. A Rosary prayer memory aid, comprising:

a slide strip having a first counting side having an outer surface with prayer indicators; and a base unit having a slot extending from one end adjacent a bottom of said unit to an opposite top end which is open, said slide being slidable in said slot and through the opening.

2. The memory aid according to claim 1, wherein said prayer indicators comprise adjacent surfaces which are easily grabable with a persons thumb.

3. The memory aid according to claim 1, wherein said base unit includes a side opposite said slot having a recess for a finger of a person.

4. The memory aid according to claim 1, wherein said base unit includes recesses for a persons fingers, said indicators being arranged as projections grippable by the persons thumb.

5. The memory aid according to claim 4, wherein there are 10 projections which may be counted.

6. A memory aid, comprising:

a slide strip having a first counting side with a surface with indicator surface regions; and a base unit having a slot extending from an open first base unit end to a slot end face adjacent to a second base unit end, said slide being slidable in said slot and through the opening.

7. The memory aid according to claim 6, wherein said indicator surface regions include raised surface portions.

8. The memory aid according to claim 6, wherein said base unit has contour regions for engagement by a users fingers.

* * * * *